US007507516B2

(12) United States Patent
Hayashi et al.

(10) Patent No.: US 7,507,516 B2
(45) Date of Patent: Mar. 24, 2009

(54) TONER AND METHOD OF MANUFACTURING TONER

(75) Inventors: Kenji Hayashi, Hachioji (JP); Kenji Yamane, Sagamihara (JP); Ryuji Kitani, Hino (JP); Kouji Sugama, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 420 days.

(21) Appl. No.: 11/444,828

(22) Filed: Jun. 1, 2006

(65) Prior Publication Data

US 2006/0292481 A1 Dec. 28, 2006

(30) Foreign Application Priority Data

Jun. 23, 2005 (JP) ..... 2005-183052

(51) Int. Cl.
*G03G 9/08* (2006.01)

(52) U.S. Cl. ..... 430/137.11; 430/137.12; 430/137.14; 430/137.15; 430/137.17

(58) Field of Classification Search ..... 430/137.11, 430/137.12, 137.14, 137.15, 137.17
See application file for complete search history.

(56) References Cited

U.S. PATENT DOCUMENTS

2005/0277044 A1 * 12/2005 Watanabe et al. ..... 430/109.3
2005/0277045 A1 * 12/2005 Saito et al. ..... 430/109.3

* cited by examiner

*Primary Examiner*—Hoa V Le
(74) *Attorney, Agent, or Firm*—Lucas & Mercanti, LLP

(57) ABSTRACT

Disclosed is a method of manufacturing toner comprising the steps of adding oil-droplets containing a radically polymerizable monomer into an associated particle dispersion formed by association-fusing resin particles and colorant particles, and forming a shell by coating a resin produced via polymerization on a surface of the associated particle by polymerizing the radically polymerizable monomer in the associated particle dispersion, wherein a hydrophilicity degree of the resin contained in the shell is larger than a hydrophilicity degree of a resin contained in the associated particle.

16 Claims, 1 Drawing Sheet

TONER AND METHOD OF MANUFACTURING TONER

This application claims priority from Japanese Patent Application No. 2005-183052 filed on Jun. 23, 2005, which is incorporated hereinto by reference.

TECHNICAL FIELD

The present invention relates to toner used for an electrophotographic type image forming apparatus, and particularly to a method of manufacturing the toner composed of a core/shell structure.

BACKGROUND

In the field of imaging technology of an electrophotography system employing copiers or printers, there has recently been demanded a technology at a level of precise reproduction of minute dot images at a level of 1200 dpi (dpi: the number of dots per inch or 2.54 cm) along with advancement of digital technologies. In order to precisely reproduce fine dot images, miniaturization of the toner particle diameter has been studied, and much attention has been paid on a chemical toner such as a polymerization toner capable of controlling various matter properties produced in a manufacturing process (refer to Patent Document 1, for example).

The chemical toner is adapted to a recent environmental consideration trend, and be capable of an environmental conscious production of toner, since carbon dioxide emissions can be reduced during manufacturing. The polymerizable toner containing a low melting point wax is also capable of forming images fixed at lower temperature than before, whereby electric power consumed by apparatuses is to be reduced (refer to Patent Document 2, for example).

On the other hand, in order to conduct the stable image formation, it is desired that the toner is designed in such a way that no component of colorant or wax is exposed on the toner surface. Consequently, the toner having a so-called core/shell structure, in which a resin is coated around a layer containing a component of colorant or wax, is provided.

Disclosed as a technique of preparing the toner having a core/shell structure is a technique in which a core/shell structure is formed by fusing resin particles on the core surface prepared via association-fusing of resin particles and colorants (refer to Patent Document 3, for example). It is also desired that components contained in the toner seep into the toner surface efficiently in order to realize good image formation with the toner having a core/shell structure. Various studies concerning the shell thickness so as to make the toner components seep into the toner surface efficiently have been made, and disclosed, for example, is a technique relating to a manufacturing process of the toner having a shell thickness of approximately a few 100 nm (refer to Patent Documents 4 and 5, for example).

(Patent Document 1) Japanese Patent O.P.I. Publication No. 2000-214629

(Patent Document 2) Japanese Patent O.P.I. Publication No. 2001-42564

(Patent Document 3) Japanese Patent O.P.I. Publication No. 2002-116574

(Patent Document 4) Japanese Patent O.P.I. Publication No. 2002-359213

(Patent Document 5) Japanese Patent O.P.I. Publication No. 2004-109939

SUMMARY

A high speed compact type image forming apparatus in view of consumer's usability is prevailing as an image forming apparatus having a structure corresponding to such the demand, but there is still a problem such that the image forming apparatus is inclined to keep heat within the interior of the apparatus. In the case of using toner for a long duration, toner fusing inside a developing device, as well as toner adhesion to the apparatus is easily generated, whereby these problems cause a factor to deteriorate toner image quality. For example, white lines are generated on an image via toner fusing inside the developing device, and insufficient charging performance is added to the toner via toner adhesion to the apparatus, whereby fog tends to be frequently generated.

The improvements to toner storage performance have been studied in order to solve this problem. However, the foregoing core/shell structure has not solved this problem sufficiently. Above all, more stable storage performance was desired to toner used for fixing at low temperature as described before, but it was difficult to solve this problem, since the toner was designed to be melted at low temperature.

It is an object of the present invention to provide toner exhibiting stable storage performance with no change in properties at high temperature. An object of the present invention is specifically to provide a method of manufacturing toner capable of generating stable storage performance with no adhesion of toner to a developing device, even though the toner is installed in a high speed compact type image forming apparatus.

Particularly, an object of the present invention is also to provide stable storage performance to toner used for fixing at low temperature, in which it used to be difficult to maintain the performance at high temperature.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DETAILED DESCRIPTION OF THE INVENTION

Figure 1:
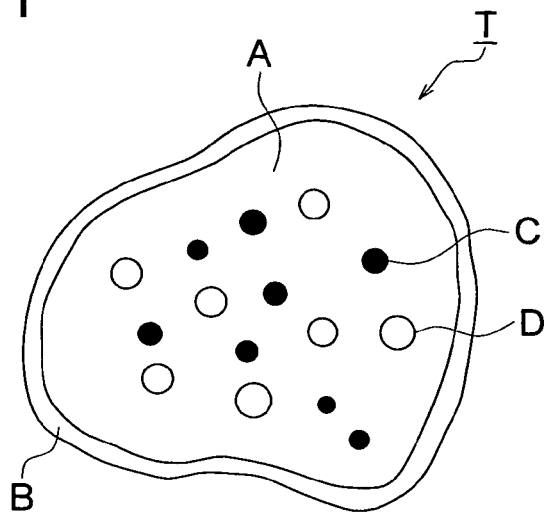
FIG. 1 is a schematic illustration showing a toner structure of the present invention.

The following two items are provided for the reason why a temperature inside the high speed compact type image forming apparatus is easy to rise. First, a downsized image forming apparatus has a structure in which heat generated inside the apparatus is difficult to dissipate since smooth air flow is deteriorated by an amount equivalent to less space in the apparatus. Secondly, the temperature increase in the paper transportation pathway occurs since transportation is carried out in the state in which the paper temperature has not dropped completely, when a paper sheet which has been fixed once with double-sided printing is transported into a developing process without stacking. Since the temperature of the photosensitive receptor surface, that of a cleaning device, and that of the interior of a developing device rise as a result, external additives are embedded because of generation of coagulated particles, toner adhering to members, and stress during toner recycling, resulting easily in a degradation phenomenon. Thus, stable toner with no degradation at high temperature is demanded.

For the above-described, the toner of the present invention employed in a high speed compact type image forming apparatus is capable of exhibiting stable storage performance with no degradation at high temperature. It is speculated that a shell is formed by polymerizing a polymerizable monomer in the presence of associated particles constituting a core. In other words, since a shell is formed under the same conditions and probability at any place on the core surface via polymerization reaction on the foregoing core surface, it is also speculated that a structure in which no core tends to be exposed on the toner surface in the case of such the evenly formed shell has been formed.

On the other hand, in the case of forming a shell employing conventional resin particles, there is a problem such that since a shell is formed by fusing resin particles, an uneven shell thickness is easily formed, whereby a region hiving a different resin density is also easily formed. Accordingly, it has been difficult to form a shell accompanied with an even thickness and no fluctuation in resin density, resulting in no stable storage performance at high temperature, since the low-melting point component of the core easily seeps into the toner surface when the toner is placed at high temperature.

Excellent fixing performance is also generated during image formation since stable storage performance is maintained in the present invention, even though a shell is thinner than toner in a conventional core/shell structure. Since the shell is formed via polymerization reaction employing associated particles as the core, a strong shell which is thin, but high in resin density can be presumably formed. As a result, it is considered that a fixing performance is also improved since a stored low melting point component at high temperature is difficult to seep out, and also a core component seeps into the toner surface by breaking a thin shell via application of pressure.

It is found that hydrophilicity of each resin constituting a core/shell structure is of a substantial factor to realize effects of the present invention, though in the case of toner of the present invention, the shell is formed by polymerizing a polymerizable monomer in the presence of associated particles forming the core. The phase separation between a core and a shell is promoted by the difference in hydrophilicity between resins, resulting presumably in easy formation of a core/shell structure. In other words, in the case of shell formation employing a monomer exhibiting low hydrophilicity, the monomer melted in the interior of a core, whereby a shell is presumably difficult to be formed distinctly on the core surface.

Further, a cross-linking agent is possible to be added into monomer mixture liquid for the shell formation to improve strength of this thin shell.

The reason why the excellent image formation can be realized by introducing a high-speed compact type image forming apparatus of the present invention is that hydrophilicity of a resin contained in a shell is higher than that of a resin contained in a core. Presumably, hydrophilicity is added at some level on the toner surface of the present invention, whereby moisture is easy to be adsorbed on the toner surface, so that the moisture functions presumably as a charging site to improve the charging speed.

It became also possible to improve charging performance of the toner having an average circularity of 0.920-0.975 exhibiting a slightly more irregular shape than a sphere. More specifically, the charging site tends to be easily concentrated at convex portions on the surface, since such the toner has a difficulty of forming the charging site on the entire surface like toner formed via suspension polymerization. Accordingly, a charging level on the entire toner surface was desired to be set to at least a predetermined level to improve the charging performance at the convex portions. However, charging stability with aging is demanded since a charging amount becomes excessive locally in the case of occurrence of the excessive charge concentration at convex portions, whereby a developing property varies with aging.

Since not only the charge rising becomes excellent through the action of moisture adsorbed on the toner surface in the present invention, but also the charge leakage can be added by the presence of the moisture, it is speculated that an excessive accumulation of charge has disappeared.

Next, toner of the present invention will be described in detail.

Toner of the present invention is composed of a core portion containing a resin and a colorant, and a shell portion containing a resin formed via polymerization of polymerizable polymers in the presence of associated particles constituting the core portion. FIG. 1 is a schematic illustration showing a toner structure of the present invention. In FIG. 1, T designates toner, A designates core, B designates shell, C designates colorant, and D designates wax. As shown in FIG. 1, the toner of the present invention has a structure in which thin shell B is uniformly coated on the entire surface of core A.

The shape of toner of the present invention has the following characteristics. A median particle diameter in terms of a volume standard is 2-7 μm, average circularity is 0.920-0.975, and the foregoing shell portion has a thickness of 10-200 nm. Hydrophilicity of the resin contained in the shell is also larger than that of the resin contained in the core.

Median particle diameter in terms of a volume standard (volume D50% diameter) is 2-7 μm as for an average particle diameter of the present invention. The median particle diameter in terms of a volume standard can be measured and calculated by using Coulter Multisizer III (produced by Beckman Coulter Inc.), connected to a computer system (produced by Beckman Coulter Inc.) for data processing.

After 20 ml of the surfactant solution (surfactant solution in which a neutral detergent containing a surfactant is diluted with pure water by 10 times) is mixed with 0.02 g of toner for the measurement, the mixture was subjected to an ultrasonic dispersion for one minute to obtain a toner dispersion. This toner dispersion is then poured, using a pipette, in a beaker containing ISOTON II (produced by Beckman Coulter Inc.) placed in a sample stand, until the measured content reaches 5-10% by weight, and a counter is set to 2500 counts to be measured. In addition, an aperture diameter of 50 μm is used.

As for the toner of the present invention, average circularity, expressed by the following formula, is within the range of 0.920-0.975, and the toner circularity is defined in the following formula.

Circularity=(Peripheral length of circle having the same area as the projected image of a toner particle)/(Peripheral length of the projected image of a toner particle)

The average circularity is a calculated value obtained by dividing the summation value of circularity of each particle by the total number of particles.

Circularity of toner is a measured value employing FPIA-2100 manufactured by Sysmex Corporation. The measurement is specifically conducted under the measuring conditions such as an HPF (high-power field imaging) mode and an appropriate concentration of a HPF detection number of 3000-10000 employing FPIA-2100, after toner mixed with a surfactant-containing aqueous solution is subjected to ultrasonic dispersion treatment for 1 minute to disperse the toner.

The toner of the present invention is toner having an irregular shape at some level in such a way that the average circularity is within the above-described range, and such the shape makes heat transfer effective, whereby fixability can further be improved, and adhesiveness of external additives can also be acquired. Images having no fog, accompanied with high-resolution images can be obtained, since fracture of particles caused by stress during operation of printing a large number of paper sheets can be avoided.

The toner of the present invention has a shell thickness of 10-200 nm, and preferably 20-100 nm. Though the shell thickness of the present invention is thinner than that of commonly known core/shell structure type toner, exposure of the core portion to the toner surface can be avoided, whereby toner fusion and adhesion to image forming apparatus members are prevented, and image formation at a fixing temperature lower than before is realized.

After existing regions of colorant (carbon black, yellow pigment, magenta pigment, or cyan pigment), wax, and so forth are confirmed via observation of TEM (transmission electron microscope) micrographs of toner, a distance from the outermost surface of toner to the core is measured to calculate the average value as the shell layer thickness. Intersection points with a straight line passing through the toner center are specifically taken into account, and 8 radial lines from the center are equidistantly provided to calculate the average value. In addition, the number of toners observed by a TEM are at least 100.

An observation method employing a transmission electron microscope is a commonly known method used when measuring toner. That is, after toner particles are dispersed in a normal temperature curable epoxy resin, embedded, and cured, they are dispersed in styrene powder having an approximate particle diameter of 100 nm, and subsequently molded by pressure. After the resulting block is subjected to dyeing employing in combination with ruthenium tetroxide or osmium tetroxide, and a thin film specimen is prepared employing a microtome equipped with a diamond tooth, micrographs concerning a cross-section of the toner are observed in a magnitude of 10000 times with a transmission electron microscope (TEM).

Utilized as a transmission electron microscope is LEM-2000 TYPE (manufactured by Topcon Corporation), or JEM-2000 FX (manufactured by JEOL Ltd.).

A problem of the present invention has been solved by focusing attention on the relation between hydrophilicity of a resin contained in a shell and that of a resin contained in a core. A level of hydrophilic progression of each of resins contained in the shell and in the core is designated as a hydrophilicity degree.

In the toner of the present invention, a hydrophilicity degree of a resin contained in shell (Sb) is larger than a hydrophilicity degree of a resin contained in core (Sa). It is preferred that difference (Sb−Sa) is at least 5, but the difference is preferably within the range of 5-40. The difference in hydrophilicity between a resin contained in a shell and a resin contained in a core is determined by comparing a hydrophilicity degree of a monomer constituting a resin contained in a core with that of a monomer constituting a resin contained in a shell. Solubility of each monomer to water is specifically used as a scale representing a hydrophilicity degree for both resins.

When each of the core and the shell is composed of a single monomer, each hydrophilicity degree can be evaluated by comparing solubility of the monomer constituting the core with that of the monomer constituting the shell. On the other hand, in the case of a copolymer resin composed of plural monomers, a hydrophilicity degree can be calculated by using solubility of each monomer to water (weight of monomer dissolved in 1 liter of water: g/liter) and a copolymerization ratio. When each ratio of 3 kinds of monomers A, B and C is set to a (% by weight), b (% by weight) and c (% by weight), and each solubility of the 3 kinds at 20° C. is also set to SA, SB and SC, a hydrophilicity degree of this resin is expressed by the following formula.

$$\text{A hydrophilicity degree of copolymer resin}=SA\cdot(a/100)+SB\cdot(b/100)+SC\cdot(c/100)$$

Herein, hydrophilicity degrees of two copolymers A and B having the different ratio of the monomers are compared employing styrene, n-butyl acrylate, or methacrylic acid as the monomer. In addition, solubility of styrene, that of n-butyl acrylate, and that of methacrylic acid at 20° C. are 0.24 (g/liter), 2 (g/liter), and 89 (g/liter), respectively.

On the one hand, when the ratio of the monomers as copolymer A is initially set to 73% of styrene, 25% of n-butyl acrylate, and 2% of methacrylic acid, the following hydrophilic degree of copolymer A is obtained.

$$\text{Hydrophilic degree } A=0.24\times(73/100)+2\times(25/100)+89\times(2/100)=2.45$$

On the other hand, when the ratio of the monomers as copolymer B is set to 70% of styrene, 25% of n-butyl acrylate, and 5% of methacrylic acid, the following hydrophilic degree of copolymer B is obtained.

$$\text{Hydrophilic degree } B=0.24\times(70/100)+2\times(25/100)+89\times(5/100)=5.12$$

It is accordingly confirmed that copolymer B has a higher hydrophilicity degree than copolymer A.

Solubility of the monomer forming a resin usable for toner of the present invention, to water at 20° C. is shown below.

TABLE 1

| Monomer | Water solubility (g/liter) | Monomer | Water solubility (g/liter) |
|---|---|---|---|
| Styrene | 0.24 | Methylmethacrylate | 15 |
| Acrylic acid | 1000 | n-butylacrylate | 2 |
| Methacrylic acid | 89 | n-butylmethacrylate | 5.8 |
| Methylacrylate | 52 | 2-ethylhexylacrylate | 0.1 |
| Ethylacrylate | 15 | 2-ethylhexylmethacrylate | 0.1 |

The reason why effects of the present invention are achieved by making a shell hydrophilicity degree larger than a core hydrophilicity degree is not clear, but the following speculation is possibly made. If a hydrophilicity degree of a monomer used for the shell formation is almost equivalent to that of a resin contained in the core, it is speculated that the monomer added on the core surface during shell formation is melt into the interior of the core, whereby it is considered to be difficult to form a clear shell definitely on the core surface. Accordingly, in order to form a shell having a high glass transition temperature on the core surface, it is desired that a monomer for the shell formation and a core are in the incompatible relation at some level, and it is speculated that the hydrophilicity degree in the present invention functions as a factor to identify incompatibility between both of them. In the case of a hydrophilicity degree of the monomer for shell formation equivalent to or less than that of the core, as described in Examples later, it is to be understood that the resulting toner has a structure in which no shell can be identified.

Next, a method of manufacturing toner of the present invention will be described.

Toner of the present invention is produced via the following processes. First, associated particles forming cores obtained via association/fusing of resin particles and colorant particles are prepared. Next, a radically polymerizable monomer is added into the associated particle dispersion to conduct a radical polymerization process in the dispersion. The resin formed via the polymerization is coated onto the associated particle surface to form shells. In this way, toner of the present invention having a core/shell structure is prepared. The radically polymerizable monomer is added into the core particle dispersion prepared by various methods, and adsorbed to the core particles to conduct a polymerization process, whereby a core/shell structure is formed by growing the particles.

Next, a method of manufacturing the present invention will be described in detail.

In preparation of a core section made of toner of the present invention, the preferred method is a method in which a wax component is dissolved in a polymerizable monomer for forming resin (A) to produce a particle dispersion in the aqueous medium mechanically, and composite resin particles formed via the process of polymerizing the polymerizable monomer by a miniemulsion polymerization method, and colorant particles are salted out and fused. In the case of dissolving a wax component in a polymerizable monomer, the wax component may be dissolved or be melted.

In the method of manufacturing of the core section, the process of subjecting the composite resin particles containing resin (A) prepared by the multistage polymerization method and colorant particles to salting-out/fusing is preferably used.

Next, a preferred example of the method of manufacturing toner (emulsifying association method) will be described in detail.

This manufacturing method may include the following processes: (1) a dissolution/dispersion process of dissolving or dispersing the wax in a radically polymerizable monomer; (2) a polymerization process of preparing a resin particle dispersion; (3) an association/fusing process of fusing associated particles via association of resin particles and colorant particles in an aqueous medium to obtain core particles (associated particles); (4) a shell formation process of preparing colored particles by forming the shell after the radical polymerization is conducted by adding the radically polymerizable monomer into a core particle (associated particle) dispersion; (5) a washing process of subjecting the colored particles to solid-liquid separation from the cooled dispersion of colored particles and removing a surfactant and the like from the colored particles; (6) a drying process of drying the colored particles having been subjected to the washing treatment; and, if desired, (7) a process of adding external additives to the colored particles having been subjected to the drying treatment.

Each of the processes will be described below.

[Dissolution/Dispersion Process]

This process is a process of dissolving a wax compound in a radically polymerizable monomer to prepare a radically polymerizable monomer solution in which the wax compound is mixed.

[Polymerization Process]

In a preferred example of the polymerization process, liquid droplets are formed employing mechanical energy by adding the radically polymerizable monomer solution containing the dissolved or dispersed ester compound admixture in an aqueous medium containing a surfactant of not more than critical micelle concentration (CMC) to develop polymerization reaction in the liquid droplets via the subsequent addition of the radical polymerization initiator. Incidentally, an oil-soluble polymerization initiator may be contained in the liquid droplets. In such a polymerization process, a treatment of forcibly emulsifying (forming liquid droplets) by applying mechanical energy is required. The means of applying the mechanical energy may include the means of applying the strong agitation or ultrasonic vibration energy such as a homo-mixer, ultrasonic waves, and Manton-Gaulin.

In the polymerization process, resin particles containing the ester compound admixture and binder resin can be obtained. The resin particles may be colored particles or uncolored particles. The colored resin particles may be obtained by subjecting the monomer composition containing a colorant to the polymerization treatment. When the uncolored resin particles are used, a colorant particle dispersion is added to the resin particle dispersion in the fusing process described below, wherein the resin particles and the colorant particles are fused to form associated particles.

[Association/Fusing Process]

As a typical method in the association/fusing process, the salting-out/fusing method in which resin particles (colored or uncolored resin particles) obtained in the polymerization process are salted out and fused at the same time, for example, is provided. Further, in the association/fusing process, in addition to the resin particles and colorant particles, internal additive particles such as wax particles and a charge control agent can be fused.

In the foregoing association/fusing process, "aqueous medium" is referred to as water of at least 50% by weight as a main component. Listed as the components other than water may be organic solvents dissolving in water including, for example, methanol, ethanol, isopropanol, butanol, acetone, methyl ethyl ketone, or tetrahydrofuran. Of these, alcohol based organic solvents such as methanol, ethanol, isopropanol, and butanol as the organic solvents dissolving no resins are particularly preferred.

The colorant particles can be prepared by dispersing a colorant in the aqueous medium. The dispersion treatment of the colorant is carried out in the state where the density of the surfactant is set to critical micelle concentration (CMC) or more in water. Although the homogenizer used for the colorant dispersion treatment is not specifically limited, preferably listed are the ultrasonic homogenizer, mechanical homogenizer, pressure homogenizers such as Manton-Gaulin and pressure type homogenizer, sand grinder, media type homogenizers such as Getzmann mill and diamond fine mill. Further, the surfactant used herein may include that similar to the surfactant as described above. Incidentally, the colorant (particles) may be subjected to surface modification. The surface modification method of the colorant is as follows: the colorant is dispersed in a solvent, and the surface modification agent is added in the molecular weight liquid thereof, and then the resulting system is reacted by raising the temperature thereof. After the reaction is completed, the colorant is filtered and sorted, repeatedly washed and filtered with the same solvent, and then is dried to obtain a colorant (pigment) having been treated with the surface modification agent.

The salting-out/fusing method which is a preferred method is a process that the salting-out agent made of a metal salt such as an alkali metal salt or an alkaline earth metal salt is added as the coagulant of not less than critical coagulation concentration in water in which resin particles and colorant particles exist, and subsequently the resulting solution is heated to a temperature which is equal to or greater than the glass transition point of the resin particle and is equal to or greater than the melting peak temperature (° C.) to develop salting-out, at the same time carrying out fusion-bonding. In this process, a method of effectively carrying out fusion-bonding by adding the organic solvent which is infinitely dissolvable in water to practically lower the glass transition temperature of the resin particle may be adopted. Listed herein as the alkali metal salt and alkaline earth metal salt which are the salting-out agents may be, lithium, potassium, sodium and the like for the alkali metals, magnesium, calcium, strontium, barium and the like for the alkaline earth metal salts, and preferably potassium, sodium, magnesium, calcium, barium. Listed as components of the salt may be chromic salt, bromine salt, iodine salt, carbonate, sulfate salt and the like. Further, listed as the organic solvents infinitely dissolvable in water may be methanol, ethanol, 1-propanol, 2-propanol, ethylene glycol, glycerin, acetone and the like, and preferably the alcohols of methanol, ethanol, 1-propanol, 2-propanol with a carbon number of 3 or less, and more preferably 2-propanol.

When the association/fusing is carried out by salting-out/fusing, a period of time for leaving the system after the salting-out agent is added is preferably as short as possible. Although the reason thereof is not clear, the following problems occur that depending on the leaving period of time after salting out, the coagulation state of the particles varies, so that the particle distribution is unstable and the surface property of the fusion bonded toner varies. Further, the temperature at which the salting-out agent is added is required to be at least equal to or smaller than the glass transition temperature of the resin particle. The reason thereof that when the temperature at-which the salting-out agent is added is equal to or greater than the glass transition temperature of the resin particle, the salting-out/fusing of the resin particle is smoothly developed while the particle diameter cannot be controlled, so that the large diameter particles would be disadvantageously generated. The range of the additive temperature may be equal to or smaller than the glass transition temperature of the resin, generally in the range of 5-55° C., and preferably 10-45° C.

In the present invention, the salting-out agent is added at the glass transition temperature of the resin particle or less, and then the temperature is raised as fast as possible to heat to the temperature which is equal to or greater than the glass transition temperature of the resin particle as well as equal to or greater than the melting peak temperature (° C.) of the ester compound having the specific structure. The period of time of this temperature rise is preferably less than one hour. Further, the temperature rise must be carried out quickly, and the temperature rise speed is preferably 0.25° C./min or more. The upper limit is not specifically determined, however, when the temperature is immediately raised, the salting-out is rapidly developed and the particle diameter is difficult to be controlled, thereby 5° C./min or less is preferred. In this fusing process, a dispersion of the associated particles (toner particles) such as the resin particles or any other particles being subjected to salting-out/fusing can be obtained.

In the shell formation process, after the adsorption to core particles by dripping a radically polymerizable monomer into an associated particle dispersion (core particle dispersion), the core particle dispersion is heated up to a temperature capable of polymerization, and polymerization reaction starts by adding an initiator to form a shell composed of a thin resin layer on the core particle surface via the polymerization reaction. In this way, the shell is uniformly formed on the core surface by polymerizing a monomer adsorbed to the core particle to obtain toner in which no core is exposed on the surface.

In the present invention, a shell having a thickness of 10-200 nm is formed on the core particle surface via the shell formation process, and a shell having a thickness of 20-100 nm is preferably formed. The shell thickness can be adjusted by controlling the reaction condition including an addition amount of a polymerizable monomer and temperature as well as time necessary for polymerization.

[Cooling Process]

This process is a process of subjecting the dispersion of the toner particles to the cooling treatment (quick cooling treatment). The condition of the cooling treatment is to cool at a cooling speed of 1-20° C./min. The method of the cooling treatment, although which is not specifically limited, may include a method of cooling by introducing a cooling medium from outside of a reaction container and a method of cooling by directly charging cool water into the reaction system.

[Solid-Liquid Separation and Washing Process]

In the solid-liquid separation and washing process, the following treatments are applied: a solid-liquid separation treatment of subjecting the colored particles to solid-liquid separation from the dispersion of the colored particles having been cooled down to a prespecified temperature in the above process; and a washing treatment of removing deposits such as the surfactant and the salting-out agent from a toner cake (an aggregation substance obtained by coagulating colored particles in a wet condition in the form of cake) having been subjected to solid-liquid separation. Herein, the filter treatment method, which is not specifically limited, may include the methods such as the centrifugal separation method, decompression filter method using Nutsche, and the filter method using a filter press.

[Drying Process]

This process is a process of subjecting the washed toner cake to the drying treatment to obtain dried colored particles. Listed as the dryer used in this process may be a spray dryer, a vacuum-freeze dryer, and a decompression dryer and the like, and it is preferred to use a stationary rack-dryer, a movable rack-dryer, a fluidized dryer, a rolling dryer, an agitation dryer and other dryers. The water content of the dried toner particle should be preferably 5% by weight or less, more preferably 2% by weight or less. Incidentally, when the toner particles having been subjected to the dry treatment are agglomerated with a small attraction force among the particles, the agglomeration may be subjected to the powder treatment. Herein, mechanical type of powder machines such as a jet-mill, a HENSCHEL MIXER, a coffee mill, a food processor and the like may be used as the powder treatment machine.

This process is a process of manufacturing the toner by mixing external additives in the dried colored particles, if desired.

As the mixer for the external additives, mechanical type of mixers such as a HENSCHEL MIXER and a coffee mill may be used.

Next, material used for preparing toner of the present invention will be described.

Toner of the present invention can be employed as a black toner or a color toner.

Next, a compound constituting toner of the present invention (binder resin, colorant, wax, charge control agent, external additive, or lubricant) will be described.

Those employed as a polymerizable monomer constituting a binder resin include styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethyl aminoethyl methacrylate, and dimethyl aminoethyl methacrylate; ester acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like, halogenated vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; and acrylic acid or methacrylic acid derivatives such as acrylonitrile, methacrylonitrile, acrylamide, and the like. These vinyl monomers can be used singly or in combination.

Further, it is more preferable that those having ionic dissociation groups as polymerizable monomers constituting resins are used in combination. Examples thereof are those each having a substituent such as carboxyl group, sulfonic acid group and phosphoric acid group as a constituting group of a monomer, and there are specifically given acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamido-2-methylpropanesulfonic acid, acidphosphoxyethyl methacrylate, 3-chloro-2-acidphosphoxypropyl methacrylate.

It is further possible to produce resins having a cross-linked structure by using polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

These polymerizable monomers can be polymerized by using radical polymerization initiators. In this case, oil-soluble polymerization initiators can be used for a suspension polymerization method. Provided as this oil-soluble polymerization initiator are azo or diazo polymerization initiators such as 2,2'-azobis-(2,4-dimethylvaleronitrile), 2,2'-azobisisobutyronitrile, 1,1'-azobis(cyclohexane-1-carbonitrile, 2,2'-azobis-4-methoxy-2,4-dimethylvaleronitrile, azobisisobutyronitrile; and peroxide polymerization initiator such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, tris-(t-butylperoxy) triazine, or high polymer initiator having peroxide on the side chain.

Further, when using an emulsion polymerization and a coagulation method, a water-soluble radical polymerization initiator can be used. Provided as the water-soluble polymerization initiator are persulfate such as potassium persulfate and ammonium persulfate, azobisamino dipropane acetate, azobiscyano valeric acid and its salt and hydrogen peroxide.

In the present invention, it is also possible to add a cross-linking agent into a monomer mixture used for shell formation to improve strength of a shell constituting toner.

Specific examples of cross-linking agents include aromatic polyvinyl compounds such as divinylbenzne and divinylnaphthalene; polyvinyl esters of aromatic polyvalent carboxylic acid such as phthalic acid divinyl, isophthalic acid divinyl, terephthalic acid divinyl, homophthalic acid divinyl, trimesic acid divinyl, trimesic acid tri vinyl, naphthalene dicarboxylic acid divinyl and biphenyl carboxylic acid divinyl; divinyl esters of nitrogen-containing aromatic compounds such as pyridine dicarboxylic acid divinyl and the like; vinyl esters of unsaturated heterocyclic compound. carboxylic acid such as pyromucic acid vinyl, furancarboxylic acid vinyl, pyrrole-2-carboxylic acid vinyl and thiophene -carboxylic acid vinyl; (meth) acrylic acid esters of linear polyhydric alcohol such as butanediol methacrylate, hexane diol acrylate, octanediol methacrylate, decane diol acrylate and dodecane diol methacrylate; (meth) acrylic acid esters of branching substitution polyhydric alcohol such as neopentylglycol dimethacrylate, 2-hydroxy-1 and 3-diacryloxy propane; acrylates such as polyethylene glycol di(meth) acrylate and polypropylene polyethylene glycol di(meth) acrylate; and polyvinyl esters of polyvalent carboxylic acid such as succinic acid divinyl, fumaric acid divinyl, maleic acid vinyl/divinyl, diglycolic acid divinyl, itaconic acid vinyl/divinyl, acetone dicarboxylic acid divinyl, glutaric acid divinyl, 3,3'-thiodipropionic acid divinyl, trans-aconitic acid divinyl/trivinyl, adipic acid divinyl, pimelic acid divinyli suberic acid divinyl, azelaic acid divinyl, sebacic acid divinyl, dodecane diacid divinyl and brassylic acid divinyl. These cross-linking agents can be used singly or in combination with at least two kinds.

Of these, preferable are (meth) acrylic acid esters of linear polyhydric alcohol such as butanediol methacrylate, hexane diol acrylate, octanediol methacrylate, decane diol acrylate and dodecane diol methacrylate; (meth) acrylic acid esters of branching substitution polyhydric alcohol such as neopentylglycol dimethacrylate, 2-hydroxy-1,3-diacryloxy propane and branching substitution polyhydric alcohol; and (meth) acrylic acid esters of linear polyhydric alcohol such as butanediol methacrylate, hexane diol acrylate, octanediol methacrylate, decane diol acrylate and dodecane diol methacrylate, accompanied with acrylates such as polyethylene glycol di(meth) acrylate and polypropylene polyethylene glycol di(meth) acrylate.

Commonly known inorganic or organic colorants may be employed as colorants of the present invention. Specific colorants are shown below.

Black colorants are carbon black such as furnace black, channel black, acetylene black, thermal black, and lamp black, and magnet powder such as magnetite and ferrite.

Examples of colorants for magenta or red include C.I. pigment red 2, C.I. pigment red 3, C.I. pigment red 5, C.I. pigment red 6, C.I. pigment red 7, C.I. pigment red 15, C.I. pigment red 16, C.I. pigment red 48; 1, C.I. pigment red 53; 1, C.I. pigment red 57; 1, C.I. pigment red 122, C.I. pigment red 123, C.I. pigment red 139, C.I. pigment red 144, C.I. pigment red 149, C.I. pigment red 166. C.I. pigment red 177, C.I. pigment red 178, and C.I. pigment red 222.

Examples of colorants for orange or yellow include C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138.

Examples of colorants for green or cyan include C.I. pigment blue 15, C.I. pigment blue 15; 2, C.I. pigment blue 15;

3, C.I. pigment blue 15; 4, C.I. pigment blue 16, C.I. pigment blue 60, pigment blue 62, pigment blue 66, and C.I. pigment green 7.

Incidentally, these colorants can be used singly or two kinds of colorants or more can be selected in combination if desired. The addition amount of colorant is 1-30% by weight, based on the total amount of toner, and is preferably arranged to be set in the range of 2-20% by weight.

Commonly known compounds such as hydrocarbon based compounds and fatty acid ester based compounds can be employed as wax used for toner of the present invention. The wax content is preferably 1-20% by weight, based on the total toner, and more preferably 3-15% by weight.

Examples of wax usable for the present invention include polyolefin wax such as polyethylene wax or polypropylene wax; long chain hydrocarbon wax such as paraffin wax or sazole wax; dialkyl ketone wax such as distearyl ketone or such; ester wax such as carnauba wax, montan wax, trimethylolpropane tribehenate, pentaerythritol tetrabehenate, pentaerythritol diacetate dibehenate, glycerin tribehenate, 1,18-octadecanediole distearate, trimellitic acid tristearyl, or distearylmaleate; and amide wax such as ethylene diaminebehenyl amide, or trimellitic acid tristearyl amide.

In the toner of the present invention, a charge control agent may be added if desired. As the charge control agent, known compounds may be used, and more specifically, a nigrosin dye, a metal salt of naphthenic acid or higher fatty acid, an alkoxylated amine, a quaternary ammonium chloride, an azo metal-complex, a salicylate metal salt or its metal-complex. Listed as the metal to be contained therein are Al, B, Ti, Fe, Co, Ni and the like. Particularly preferred compound as the charge control agent is the metal-complex compound of benzilic acid derivatives. Incidentally, when the content ratio of the charge control agent is preferably set to 0.1-20.0% by weight based on the total toner, good results may be obtained.

External additives may be mixed and used in the toner particles for the purpose of improving the charge property and increasing the cleaning property and other purposes. The external agent is not specifically limited and various types of inorganic fine particles, organic fine particles, and lubricants may be used.

As the inorganic particles, known particles may be used. More specifically, such particles of silica, titania, alumina, strontium titanate may preferably be used. These inorganic particles that are subjected to hydrophobic treatment may be used if desired. Listed as the specific silica particles may be, for example, the commercially available products manufactured by Nippon Aerosil Co., Ltd. such as R-805, R-976, R-974, R-972, R-812 and R-809; HVK-2150, H-200 manufactured by Hoechst Co., Ltd.; the commercially available products manufactured by Cabot Co., Ltd. such as TS-720, TS-530, TS-610, H-5, MS-5 and the like.

Listed as the titania particles may be, for example, the commercially available products manufactured by Nippon Aerosil Co., Ltd. such as T-805, T-604; the commercially available products manufactured by Tayca Co., Ltd. such as MT-100S, MT-100B, MT-500BS, MT-600, MT-600SS, JA-1; the commercially available products manufactured by Fuji Titan Co., Ltd. such as TA-300SI, TA-500, TAF-130, TAF-510, TAF-510T; the commercially available products manufactured by Idemitsu Co., Ltd. such as IT-S, IT-OA, IT-OB, IT-OC and the like.

Listed as the alumina particles may be, for example, commercially available products manufactured by Nippon Aerosil Co., Ltd. such as RFY-C, C-604; the commercially available product manufactured by Ishihara Sangyo Kaisha Ltd. such as TTO-55 and the like.

Further, as the organic particles, those having a number average primary particle diameter of approximately 10-2000 nm with a spherical shape may be used. More specifically, homopolymers such as styrene and methyl methacrylate and their copolymer may be used.

The addition amount of these external additives is preferably 0.1-10.0% by weight based on the total toner. As the method of adding the external additive, various types of known mixers may be used such as, a turbular mixer, a HENSCHEL MIXER, a nauter mixer, and a V-type mixer.

In the toner of the present invention, a lubricant may be mixed and used in the toner particles for the purpose of increasing the cleaning property and transfer property if desired. Listed as the lubricant may be, for example, the metal salts of higher fatty acid such as the salts of zinc stearate, aluminum stearate, copper stearate, magnesium stearate, calcium stearate; the salts of zinc oleate, manganese oleate, iron oleate, copper oleate, magnesium oleate; the salts of zinc palmitate, copper palmitate, magnesium palmitate, calcium palmitate; the salts of zinc linoleate, calcium linoleate; the salts of zinc ricinoleate, calcium ricinoleate and the like.

The addition amount of these external additives is preferably 0.1-10.0% by weight based on the total toner. As the method of adding the lubricants, various types of known mixers may be used such as, a turbular mixer, a HENSCHEL MIXER, a nauter mixer, and a V-type mixer.

The toner of the present invention may be used as a single-component developer or a double-component developer. When used as the single-component developer, the toner may be formed as a magnetic single-component developer in which magnetic particles of approximately 0.1-0.5 μm is contained in a non-magnetic single-component developer or a toner, which can be used in either cases. Further, the toner may be used as the double-component developer by mixing with a carrier. In this case, as the magnetic particles of the carrier, known materials represented by magnetic particles containing iron such as iron, ferrite, and magnetite may be used, of these particularly preferred is the ferrite particle or the magnetite particle of the above carriers is preferably 15-100 μm, and more preferably 20-80 μm.

The measurement of the average particle diameter in the particle size distribution on a volume basis of the carrier may be conducted employing a laser diffraction type particle size distribution measuring machine "HELOS" (manufactured by Sympatec Co., Ltd.).

As the carrier, a coating carrier in which the magnetic particles are further coated with a resin, or a so-called resin dispersion type carrier in which the magnetic particles are dispersed in a resin is preferred. The resin composition for coating is not specifically limited, and such resins may be used including, for example, olefin resin, styrene resin, styrene-acrylic resin, silicon resin, ester resin or polymer resin containing fluorine. Further, the resin for composing the resin dispersion type carrier is not specifically limited and commonly known resins may be used including, for example, styrene-acrylic resin, polyester resin, fluorine resin, phenol resin.

Further, the mixing ratio of the carrier and the toner is preferably in the range of carrier:toner=1:1 through 50:1 in the weight ratio.

Next, an image forming apparatus usable for toner of the present invention will be described.

Figure 2:
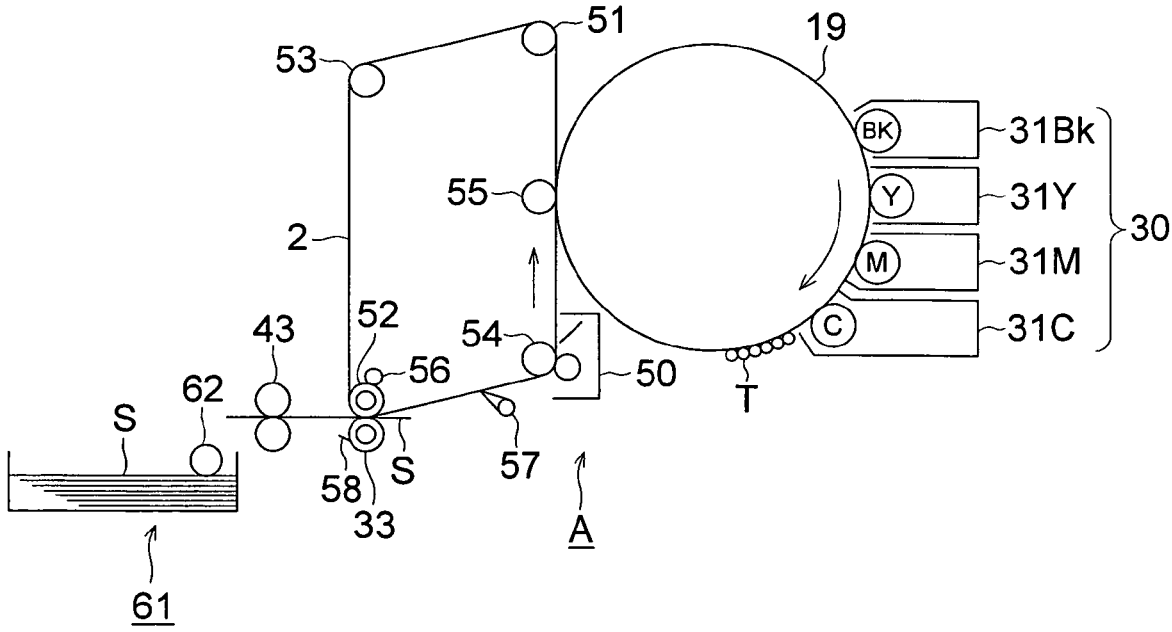
FIG. 2 is a schematic cross-sectional view showing an image forming apparatus capable of using toner of the present invention.

FIG. 2 shows an example of an image forming apparatus capable of forming a full color toner image. The image forming apparatus in FIG. 2 is equipped with photoreceptor drum 19 as a image carrier, intermediate transfer belt 2 as an intermediate transfer image body, a bias roller (the second transfer means) as a transfer electrode, a paper sheet tray to supply recording paper sheets as a transfer medium, a developing device with Bk (black) toner, a developing device with Y (yellow) toner, a developing device with M (magenta) toner, a developing device with C (cyan) toner, an intermediate transfer image body cleaner, a peeling claw, belt rollers 51, 53 and 54, back-up roller 52, electrically conductive roller 55 employed for the first transfer means, electrode roller 56, cleaning blade 31, recording paper sheet 41, a pick-up roller, and a feed roller.

Photoreceptor drum 19 is rotated in the direction of the arrow in FIG. 2 to charge the drum surface uniformly with a charging device which is not shown. An electrostatic latent image of the first color (for example, Bk) is formed on charged photoreceptor drum 19 by an image writing means such as a laser writing device of such. This electrostatic latent image is developed by a black developing device to form black toner image T. Toner image T is carried into the primary transfer section in which electrically conductive roller 55 (the first transfer means) is placed, via rotation of photoreceptor drum 1. The primary transfer is conducted by rotating intermediate transfer belt 2 in the direction of the arrow, while toner image T is electrostatically adsorbed onto intermediate transfer belt 2 of the present invention by an electric field action of reverse polarity caused by electrically conductive roller 55.

Next, in a similar way, a multicolor toner image is formed by sequentially superimposing the second color toner image, the third color toner image, and the fourth color toner image on intermediate transfer belt 2. The multicolor toner image transferred into intermediate transfer belt 2 is carried into the secondary transfer section in which a bias roller (the second transfer means) is placed, via rotation of intermediate transfer belt 2. The second transfer section is composed of a bias roller placed on the surface side of toner image carrying intermediate transfer belt 2, back-up roller 52 placed so as to face a bias roller from the back side of intermediate transfer belt 2, and electrode roller 56 rotating while pressing back-up roller 52.

Recording paper sheets in a stack of recording paper sheets collected in a paper sheet tray are removed piece by piece by a pick-up roller, and fed to the place between intermediate transfer belt 2 and a bias roller in the secondary transfer section at the predetermined time by feed roller 43. Toner image T carried into intermediate transfer belt 2 is transferred via pressing conveyance by a bias roller and back-up roller 52, and rotation of intermediate transfer belt 2.

The recording paper sheet onto which a toner image is transferred is peeled from intermediate transfer belt 2 via operation of a peeling claw placed at an evacuated position until the primary transfer of the final toner image is terminated, and a toner image is fixed via pressure/heat treatment after transporting the recording paper sheet into a fixing device which is not shown in the figures to obtain a fixed image. Intermediate transfer belt 2 in which multicolor toner image transfer onto the recording paper sheet is terminated is prepared for the next transfer after removing the remaining toner employing an intermediate transfer image body-cleaner installed on the downstream side of the secondary transfer section. The bias roller is equipped with a cleaning blade made of a resin such as polyurethane or such, so as to be brought into contact constantly with the cleaning blade to remove the toner and paper powder adhering during transfer.

In the case of transfer of a monochrome image, toner image T obtained by the primary transfer is secondarily transferred to transport into a fixing device, whereas in the case of transfer of a multicolor image formed by a plural color toner image as shown in FIG. 2, the transfer is completed with no misalignment of a toner image of each color by synchronizing the rotation of intermediate transfer belt 2 and photoreceptor drum 19 in such a way that the toner image of each color coincides precisely at the primary transfer section.

The above-described recording paper as well as a transfer material employed in the present invention means a support retaining a toner image, which is commonly called an ordinary image support, a transfer member or a transfer sheet. Though specifically provided are various image receiving materials such as plain paper sheets from a thin paper sheet to a thick paper sheet, an art paper sheet, printing paper sheets of a coated paper sheet and such, commercially viable Japanese paper or post card paper sheet, a plastic film sheet for OHP, and cloth, they are not limited thereto.

The image forming apparatus usable for toner of the present invention has the above-described configuration, and particularly provided is, for example, a compact type image forming apparatus capable of printing 50 paper sheets of A4-size per one minute in full color at high speed. Such a high-speed compact type image forming apparatus results in producing problems such that input toner is easily deteriorated since the structure in which temperature inside the apparatus is easy to rise has been designed.

This is, in the case of a compact type image forming apparatus, heat generated inside the apparatus is difficult to be released since the air stream is deteriorated by an amount equivalent to less interspace. Thus, in cases when paper sheets which have been fixed once are transported into a developing process without stacking them in the case of a double-sided print, the paper sheets have been transported at the state where the paper temperature does not drop sufficiently, whereby temperature at the transportation pathway tends to rise. As a result, easily produced are problems such that toner is coagulated and attached to the members by increasing the temperature of the photoreceptor surface, a cleaning device and the interior of a developing device, and external additives are also buried because of stress.

Toner of the present invention can exhibit stable storage performance as well as image forming performance, even though the toner is applied for a high-speed compact type image forming apparatus.

EXAMPLE

Next, the present invention will be explained employing examples, but the-present invention is not limited thereto.

1. Preparation of Toner (1) Preparation of Resin Particles for Cores (The First Step Polymerization)

A monomer mixture liquid containing the following compounds was introduced into a stainless vessel equipped with a stirring device, and was dissolved by heating at 70° C. after adding 100 g of pentaerythritol tetrabehanate ester to prepare another monomer mixture liquid.

| | |
|---|---|
| styrene (monomer component ratio of 72%) | 180.0 g |
| n-butyl acrylate (monomer component ratio of 27%) | 67.5 g |
| methacrylic acid (monomer component ratio of 1%) | 2.5 g |
| n-octyl-3-mercaptopropionate | 7.0 g |

On the other hand, a surfactant solution in which 2 g of polyoxyethylene-2-dodecylether sodium sulfate was dissolved in 1350 g of ion-exchange water was heated to 70° C., and after mixing by adding this solution into the foregoing monomer mixture liquid, the emulsion dispersion was prepared via a mixture-dispersion process conducted at 70° C.

for 30 minutes with a mechanical homogenizer having a circulation path "CLEARMIX" (produced by M Tech Co., Ltd.).

Next, an initiator solution in which 7.5 g of potassium persulfate was dissolved in 150 g of ion-exchange water was added into this solution, and the system was polymerized at 78° C. while stirring for 1.5 hours to prepare resin particle dispersion 1A.

(The Second Step Polymerization)

An initiator solution in which 12 g of potassium persulfate was dissolved in 220 g of ion-exchange water was added into the above-described resulting resin particle dispersion, and a monomer mixture liquid containing the following compounds was dripped to the solution spending 1 hour at 80° C.

| | |
|---|---|
| styrene (monomer component ratio of 72%) | 328 g |
| n-butyl acrylate (monomer component ratio of 27%) | 123 g |
| methacrylic acid (monomer component ratio of 1%) | 4.6 g |
| n-octyl-3-mercaptopropionate | 7.5 g |

After dripping of the solution is completed, a polymerization process was subsequently conducted by heating while stirring for 2 hours to prepare resin particles, and the inner temperature was subsequently cooled down to 28° C. to prepare resin particle dispersion 1B. In addition, this resin particle B has a glass transition temperature of 41° C., a hydrophilicity degree of 1.60, and a weight average molecular weight of 30000.

(Preparation of Colorant Dispersion Bk)

90 g of dodecyl sodium sulfate was dissolved in 1600 g of ion-exchange water while stirring. To this solution, 400 g of carbon black (Regal 330R, product of Cabot Co.) was gradually added with stirring and then dispersed employing a mechanical homogenizer (CLEARMIX, produced by M Technique Co., Ltd.) to obtain colorant dispersion Bk. The colorant particle diameter of colorant dispersion Bk, which was measured employing an electrophoresis light scattering photometer (ELS-800, product of Ohtsuka Denshi Co.), was 110 nm.

(Preparation of Colorant Dispersions C, M and Y)

Colorant dispersion M was prepared similarly, except that 400 g of carbon black (Regal 330R produced by Cabot Co.) used in preparation of colorant dispersion Bk was replaced to 200 g of "C.I. pigment blue 15:3". Colorant dispersion M was prepared via replacement by 340 g of "C.I. pigment red 122", and colorant dispersion Y was also prepared via replacement by "C.I. pigment yellow 74". Each colorant particle diameter of these colorant dispersions, which was measured employing an electrophoresis light scattering photometer (ELS-800, product of Ohtsuka Denshi Co.), was 110 nm.

[Association Process (Coagulation/Fusing)]

| | |
|---|---|
| Resin particle dispersion 1B | 2000 g |
| Ion-exchange water | 670 g |
| Colorant dispersion Bk | 400 g |

The above solution was charged and stirred in a reaction container equipped with a temperature sensor, a cooling tube, a nitrogen introducing device and a stirring device, and after the liquid temperature was set to 30° C., pH was adjusted to 10 by adding 5N of sodium hydrate aqueous solution into this solution.

Next, an aqueous solution in which 60 g of magnesium chloride-hexahydrate was dissolved in 60 g of ion-exchange water was added at 30° C. spending 10 minutes, while stirring. After standing for 3 minutes, a temperature of this system started being increased to raise the temperature up to 98° C. spending 60 minutes, whereby an association reaction was conducted to grow the particle diameter. The association particle diameter was measured in this state by Coulter Multisizer III (produced by Beckman Coulter), and at the time when median particle diameter in terms of a volume standard reached 5 μm, the particle growth was terminated by converting an aqueous solution in which 8.5 g of sodium chloride was dissolved in 35 g of ion-exchange water, into a salt. Further, a ripening process was continued at 98° C. until circularity of the particles reached a value shown in Table 2 to prepare core particles.

(2) Formation of Shells

Monomer mixture liquid of 36.92 g of styrene, 11.44 g of n-butyl acrylate, 3.64 g of methacrylic acid and 1.3 g of n-octyl-3-mercaptopropionate was dripped in the above core particle dispersion to be adsorbed to core particles. Next, an initiator solution in which 14.5 g of potassium persulfate was dissolved in 400 g of ion-exchange water was added into this to polymerize at 80° C. for 3 hours. Thereafter, the liquid was cooled down to 30° C. and the pH was adjusted to 4.0, and then the stirring was stopped. Colorant particle 1 Bk having a core/shell structure in which a shell was coated onto the core particle surface was prepared.

(3) Washing/Drying Process

The dispersion of prepared colored particle 1Bk was separated by a basket type centrifugal separator Mark III type No. 60×40 manufactured by Matsumoto Kikai Mfg. Co. Ltd. to produce a wet cake of the toner base material. The wet cake was washed in water employing the above basket type centrifugal separator until separated liquid reached 5 μS/cm in electrical conductivity, and then moved to Flash Jet Dryer produced by Seishin Enterprise Co., Ltd. and dried until the moisture content was reduced by 0.5% by weight, to prepare colored particle 1Bk.

(4) Preparation of Toner 1

The above colored particle 1 was prepared by adding 1% by weight of hydrophobic silica (number average primary particle diameter of 12 nm and hydrophobicity of 68) and 0.3% by weight of hydrophobic titanium oxide(number average primary particle diameter of 20 nm and hydrophobicity of 63) to mix with a "HENSCHEL MIXER" (manufactured by Mitsui-Miike Chemical Industry Co., Ltd.) to prepare toner 1Bk. Comparative data of toner 1Bk including median particle diameter (μm) in terms of a volume standard, the average circularity, shell layer thickness and hydrophilicity of the core/shell resin are shown in Table 2.

In preparation of toner 1Bk, cyan color toner 1C was prepared similarly, except that 400 g of colorant dispersion Bk was replaced by 200 g of colorant dispersion C in the above association process. Magenta color toner 1M was prepared similarly, except that 400 g of colorant dispersion Bk was replaced by 340 g of colorant dispersion M, and yellow color toner 1Y was prepared similarly, except that 400 g of colorant dispersion Bk was replaced by 360 g of colorant dispersion Y. These color toners had the same results of the median particle diameter in terms of a volume standard, the average circularity, shell layer thickness and hydrophilicity of the core/shell resin as in toner 1Bk. In addition, the physical property value of toner 1 shown in Table 2 means that any of toners 1Bk, 1C, 1M and 1Y results in the same value as toner 1.

(5) Preparation of Toners 2-15, 18, and 19

Colorant particle 2 (2Bk) having a core/shell structure was prepared similarly, except that an addition amount of the monomer mixture liquid used in a shell formation process of above-described toner 1 (1Bk) was replaced by the addition amount indicated in Table 2 to prepare toner 2 (2Bk, 2C, 2M and 2Y) via external additive addition treatment. In addition, the same physical property value of each of color toners 2C, 2M and 2Y was obtained as that of black toner 2Bk.

In a similar manner, toners 3 (3Bk, 3C, 3M and 3Y)-11 (11Bk, 11C, 11M and 11Y) having a core/shell structure, and comparative toners 18 and 19 were prepared employing monomers used for shell formation as shown in Table 2. In addition, the physical property value of toners 3-11, 18, or 19 means that any of black toners, cyan toner, magenta toner and yellow toner results in the same value as the corresponding toner.

Toners 12 (12Bk, 12C, 12M and 12Y)-15 (15Bk, 15C, 15M and 15Y) were prepared similarly to procedure of toner 1, except that the particle growth was terminated at the time when the median particle diameter in terms of a volume standard reached 1.5 μm, 2.0 μm, 7.0 μm, or 8.0 μm in a process of preparing associated particles of toner 1.

In addition, the amount of octanediol methacrylate indicated in Table 2 was added into a monomer mixture liquid used for shells of toners 1-3, 5, and 6 to form shells.

(6) Preparation of Comparative Toner 6

Comparative toner 16 was prepared similarly, except that a shell formation process of the above toner 1 was replaced by the following shell formation process.

(Preparation of Resin Particles Used for Shells)

A surfactant solution in which 8 g of dodecyl sodium sulfate was dissolved in 3000 g of ion-exchange water was charged in a stainless vessel (SUS vessel) equipped with a stirring device, a temperature sensor, a cooling tube and a nitrogen introducing device, and the inner temperature was raised up to 80° C. while stirring at a stirring speed of 230 rpm under the nitrogen flow.

A solution in which 10 g of potassium persulfate was dissolved in 200 g of ion-exchange water was also added into this surfactant solution, the following monomer mixture liquid was dripped to the solution spending 100 minutes after the inner temperature was raised up to 80° C., and a polymerization process was conducted by heating at 80° C. for 2 hours while stirring to prepare a resin particle dispersion for shells. This designates "resin particle dispersion (2 L)".

| | |
|---|---|
| Styrene (monomer component ratio of 76%) | 328 g |
| n-butyl acrylate (monomer component ratio of 22%) | 123 g |
| Methacrylic acid (monomer component ratio of 2%) | 4.6 g |
| n-octyl-3-mercaptopropionate | 5.5 g |

Resin particles constituting resin particle solution (2 L) have 11,000 in peal molecular weight and 128 nm in weight average particle diameter.

(Shell Formation)

96 g of resin particle dispersion (2 L) in terms of solid conversion was added into the dispersion of resin particle B constituting a core particle, and resin particle (2 L) was fused on the surface of resin particle B by continuously heating for 3 hours while stirring. After 40.2 g of sodium chloride was added, the liquid was cooled down to 30° C. with 8° C./min. and the pH was adjusted to 2.0, and then the stirring was stopped. After the resulting fused particle dispersion was subsequently filtrated, repeatedly washed by ion-exchange water of 45° C., and dried with hot-air of 40° C., the external additive treatment was conducted to prepare comparative toner 16 (16 Bk, 16C, 16M, 16Y) having a core/shell structure.

(7) Preparation of Comparative Toner 17

A monomer composed of 78 parts by weight of styrene and 22 parts by weight of n-butyl acrylate (calculated Tg of the resulting copolymer: 50° C.), 7 parts-by weight of carbon black (Printex 150T produced by Degssa Co., Ltd.), 1 part by weight of charge control agent (Spironblack TRH produced by Hodogaya Chemical Co., Ltd.), and 0.3 parts by weight of divinyl benzene were dispersed at room temperature by a ball mill to prepare homogeneous mixture liquid as the monomer admixture for cores. In addition, hydrophilicity degree Sa of the monomer component of the above homogeneous mixture liquid is 0.63.

On the one hand, 3 parts by weight of methylmethacrylate (calculated Tg: 105° C.), 100 parts by weight of water, and 0.01 parts by weight of charge control agent (Bontron produced by Orient Chemical Industries, Ltd.) were microscopically dispersion-treated by an ultrasonic emulsion machine to prepare water-dispersible liquid of the monomer for shells. The resulting liquid droplets having a concentration of 3% were added into 1% by weight of sodium hexametaphosphate, and the particle diameter of liquid droplets of the monomer for shells was measured by a MICROTRAC particle size distribution analyzer, whereby a volume particle diameter in D90 of 1.6 μm was obtained. In addition, hydrophilicity degree Sb of the monomer for shells is 15.

On the other hand, magnesium hydrate colloid (water-insoluble metal hydroxide) dispersion was prepared by gradually adding an aqueous solution in which 6.9 parts by weight of sodium hydrate (alkali metal hydroxide) were dissolved in 50 parts by weight of ion-exchange water, into an aqueous solution in which 9.8 parts by weight of magnesium chloride (water-soluble polyvalent metal salt) were dissolved in 250 parts by weight of ion-exchange water, while stirring. The particle diameter distribution of the above colloid was measured by a MICROTRAC particle size distribution analyzer (produced by Nikkiso Co., Ltd.), whereby a number particle diameter in D50 (50% cumulative value of number particle diameter distribution) of 0.38 μm was obtained, and a number particle diameter in D90 (90% cumulative value of number particle diameter distribution) of 0.82 μm was obtained. The measurement was carried out with a measuring range of 0.12-704 μm. a measuring time of 30 sec., and a medium of ion-exchange water, employing this MICROTRAC particle size distribution analyzer.

After a homogeneous mixed liquid of the above monomer admixture for cores was charged into the above resulting magnesium hydrate colloid dispersion, and stirred, 4 parts by weight of t-butylper-oxy-2-ethyl hexanoate was further charged while high shear-stirring in 12000 rpm employing a TK type homo-mixer to granulate liquid droplets of the monomer admixture for cores. After a water dispersion of the granulated monomer admixture was charged in a reaction container equipped with a stirring blade to initiate polymerization reaction at 90° C., and a polymerization conversion ratio reached 95%, the temperature remained constant, and after the foregoing monomer for shells and 1 part by weight of 2,2'-azobis{2-methyl-N-[1,1bis(hydroxymethyl)-2-hydroxyethyl]propion amide} were added to continue the reaction for 3 hours, and the reaction was terminated to prepare a water dispersion of colored particles having a core/shell structure.

Median particle diameter D50 in terms of a volume standard of core particles measured immediately before adding the monomer for shells was 6.3 μm, and median particle diameter D50 in terms of a volume standard of colored particles was 6.5 μm.

After the pH in the system was adjusted to 4 employing sulfuric acid to conduct acid cleaning at 25° C. for 10 minutes, and to separate water via filtration, while stirring an aqueous dispersion of the above resulting colored particles having a core/shell structure, the slurry was produced again by charging 500 parts by weight of newly added ion-exchange water to conduct water cleaning. After dehydration and water cleaning were subsequently repeated several times, and the solid content was separated via filtration, a drying process was carried out at 45° C. for two days and nights to prepare colored particles.

employing these. Incidentally, any of physical property values of the resulting color toner is the same value as in 17 Bk.

Median particle diameter (μm) in terms of a volume standard, average circularity, shell thickness, difference in hydrophilicity degree of resins contained in cores and shells, and so forth in the resulting toner 1 (1Bk, 1C, 1M and 1Y)—toner 19 (19Bk, 19C, 19M and 19Y) are shown in Table 2.

TABLE 2-1

| Toner No. | *1 | *2 | Tg | Monomer combination | Addition amount (g) | Monomer ratio | *3 | * | *4 | *5 | Average circularity | Shell thickness (nm) |
|---|---|---|---|---|---|---|---|---|---|---|---|---|
| | Shell conditions | | | | | | | | | | | |
| 1 | 5.24 | 6.84 | 55 | St/n-BA/MAA | 36.92/11.44/3.64 | 71/22/7 | 52.00 | 1.300 | 0.8 | 5.0 | 0.962 | 80.3 |
| 2 | 9.02 | 10.62 | 50 | St/n-BA/AA | 40.4/11.44/0.52 | 77/22/1 | 52.00 | 1.300 | 0.8 | 5.0 | 0.961 | 81.0 |
| 3 | 24.02 | 25.62 | 50 | St/n-BA/AA | 39.26/11.44/1.3 | 75.5/22/2.5 | 52.00 | 1.300 | 0.8 | 5.0 | 0.965 | 80.6 |
| 4 | 19.02 | 20.62 | 50 | St/n-BA/AA | 7.98/2.31/0.21 | 76/22/2 | 10.5 | 0.263 | — | 5.0 | 0.945 | 10.5 |
| 5 | 19.02 | 20.62 | 50 | St/n-BA/AA | 11.93/3.45/0.31 | 76/22/2 | 15.7 | 0.393 | 0.8 | 5.0 | 0.947 | 20.4 |
| 6 | 19.02 | 20.62 | 50 | St/n-BA/AA | 39.52/11.44/1.04 | 76/22/2 | 52.00 | 1.300 | 2.6 | 5.2 | 0.954 | 80.1 |
| 7 | 19.02 | 20.62 | 50 | St/n-BA/AA | 47.96/13.88/1.26 | 76/22/2 | 63.1 | 1.575 | — | 5.2 | 0.954 | 102.0 |
| 8 | 19.02 | 20.62 | 50 | St/n-BA/AA | 71.74/20.77/1.89 | 76/22/2 | 94.4 | 2.350 | — | 5.4 | 0.963 | 197.3 |
| 9 | 4.35 | 5.95 | 54 | St/n-BA/MAA | 37.44/11.44/3.12 | 72/22/6 | 52.00 | 1.300 | — | 5.2 | 0.955 | 45.0 |

*1: Difference in hydrophilicity degree (Sb − Sa),
*2: Hydrophilicity degree (Sb)
*3: Total amount of monomer (g),
*4: Cross-linking agent (g)
*5: Toner particle diameter (μm)
*: Addition amount of n-octyl-3-mercaptopropionate (g)
*a: Unmeasurable
Octanediol methacrylate used as the cross-linking agent, hydrophilicity degree of core particles (Sa) = 1.60 and glass transition temperature = 41° C., St: Styrene, n-BA: n-butyl acrylate, MAA: methacrylic acid, AA: acrylic acid, MMA: methylmethacrylate, and Tg: Glass transition temperature (° C.).

TABLE 2-2

| Toner No. | *1 | *2 | Tg | Monomer combination | Addition amount (g) | Monomer ratio | *3 | * | *4 | *5 | Average circularity | Shell thickness (nm) |
|---|---|---|---|---|---|---|---|---|---|---|---|---|
| | Shell conditions | | | | | | | | | | | |
| 10 | 19.02 | 20.62 | 50 | St/n-BA/AA | 4.18/1.21/0.11 | 76/22/2 | 5.5 | 0.125 | — | 5.0 | 0.945 | 7.7 |
| 11 | 19.02 | 20.62 | 50 | St/n-BA/AA | 98.65/28.56/2.60 | 76/22/2 | 129.8 | 3.150 | — | 5.5 | 0.970 | 256.0 |
| 12 | 19.02 | 20.62 | 50 | St/n-BA/AA | 7.98/2.31/0.21 | 76/22/2 | 10.5 | 0.263 | — | 1.5 | 0.900 | 9.5 |
| 13 | 19.02 | 20.62 | 50 | St/n-BA/AA | 7.98/2.31/0.21 | 76/22/2 | 10.5 | 0.263 | — | 2.1 | 0.920 | 10.1 |
| 14 | 19.02 | 20.62 | 50 | St/n-BA/AA | 7.98/2.31/0.21 | 76/22/2 | 10.5 | 0.263 | 0.5 | 7.0 | 0.972 | 13.5 |
| 15 | 19.02 | 20.62 | 50 | St/n-BA/AA | 7.98/2.31/0.21 | 76/22/2 | 10.5 | 0.263 | — | 8.0 | 0.975 | 15.8 |
| 16 | 0.80 | 2.40 | 50 | St/n-BA/MAA | — | 76/22/2 | — | — | — | 5.6 | 0.960 | 284.2 |
| 17 | 14.92 | 15.00 | 105 | MMA | — | 100 | 30 | — | — | 6.5 | 0.985 | 20.0 |
| 18 | 0 | 1.60 | 41 | St/n-BA/MAA | 37.44/14.04/0.52 | 72/27/1 | 52.00 | 1.300 | — | 5.2 | 0.964 | *a |
| 19 | −0.92 | 0.68 | 44 | St/n-BA/— | 39/13 | 75/25 | 52.00 | 1.300 | — | 5.0 | 0.960 | *a |

*1: Difference in hydrophilicity degree (Sb − Sa),
*2: Hydrophilicity degree (Sb)
*3: Total amount of monomer (g),
*4: Cross-linking agent (g)
*5: Toner particle diameter (μm)
*: Addition amount of n-octyl-3-mercaptopropionate (g)
*a: Unmeasurable
Octanediol methacrylate used as the cross-linking agent, hydrophilicity degree of core particles (Sa) = 1.60 and glass transition temperature = 41° C., St: Styrene, n-BA: n-butyl acrylate, MAA: methacrylic acid, AA: acrylic acid, MMA: methylmethacrylate, and Tg: Glass transition temperature (° C.).

The above resulting colored particles having a core/shell structure were subjected to the same external additive treatment described previously to prepare comparative toner 17 (17 Bk).

In addition, the monomer admixture for cores was prepared similarly, except that carbon black was replaced by 4.5 parts by weight of "C.I. pigment blue 15:3" as a colorant in a process of producing the above monomer admixture for cores. The monomer admixture for cores with replacement by 4.5 parts by weight of "C.I. pigment red 15:3" and the monomer admixture for cores with replacement by 4.5 parts by weight of "C.I. pigment yellow 74" were also prepared respectively to produce color toners 17C, 17M, and 17Y Ferrite carriers having a volume average particle diameter of 60 μm, covered by a silicone resin were mixed with each toner described in Table 2 to prepare developer 1 (1Bk, 1C, 1M and 1Y)—developer 19 (19Bk, 19C, 19M and 19Y) by adjusting so as to have a toner concentration of 6%. The following evaluations employing developer 1-developer 15, and developer 16-developer 19 correspond to Examples 1-15, and Comparative examples 1-4, respectively.

Evaluation Experiment (1) Evaluation Apparatus

The evaluation was carried out employing Magicolor 5440DL (produced by Konica Minolta Holdings, Inc.) as an evaluation apparatus, including an image formation process described in Table 2. In addition, a fixing speed and a thermal roller surface temperature were set to 245 mm/sec (approximately 50 sheets/minute: A4 size and transverse feed) and 150° C., respectively.

(2) Evaluation Items

After a temperature sensor was located at the position close to a developing device inside the above evaluation apparatus, and connected to a device of monitoring the temperature inside the apparatus, double-sided printing was continuously conducted until the temperature inside the apparatus reached 65° C. An image having a pixel ratio of 10% (an original image document allocating four equal quarters for each of a text image having a pixel ratio of 7%, a portrait, a solid white image, and a solid black image) was printed out at the time when the temperature inside the apparatus reached 65° C. to evaluate the following.

<Occurrence of White Line>

Prints of the above original image document were determined via the following evaluation.

A: No occurrence even on the solid black image

B: Some portions where density is slightly lowered in the form of lines on the solid black image.

C: Some white lines are observed on the solid black image, but invisible in a practical image such as printer image or such (available in practical use).

D: White lines are observed even in a practical image (practically unavailable).

<Fog>

The occurrence of fog was evaluated on the sold white image of the above original image prints. The absolute image density of not printed white paper was measured at 20 points employing a Macbeth Reflective Densitometer RD-918, and the calculated average value was specified as the white paper density. Next, the absolute density of the solid white image portion in the formed image for evaluation was similarly measured at 20 points, and the average value was calculated to evaluate the value obtained via subtraction of the white paper density from the average density as fog density. In the case of the fog density of 0.010 or less, fog was evaluated, resulting in no problem in practical use.

A: 0.003 or less

B: 0.006 or less

C: 0.01 or less

D: Larger than 0.010

<Thin Line Reproduction>

A thin line image corresponding to 2-dot line image signals was formed, and the line widths of the printed toner images were measured by a print evaluation system RT2000 (produced by YA-MAN Ltd.). Thin lines of 100 μm wide were arranged, and line width variations on the first and 3000th sheets were evaluated. The evaluation was carried out via visual observation employing a 10 times magnifying glass, whereby obtained thin lines printed on the first sheets were all 100 μm wide.

The Evaluation Criteria are as Follows:

A: Line width variation of less than 7 μm

B: Line width variation of at least 7 μm and less than 15 μm

C: Line width variation of at least 15 μm

After the temperature inside the apparatus reached 65° C., and 1000 sheets were continuously printed, 20 g of the remaining toner inside the apparatus was removed, and sieved by a sieve of 45 μm opening to evaluate in the amount of coagulated product remaining on the sieve (the number).

The Evaluation Criteria are as Follows:

A: An amount of coagulated product remaining on a sieve is at least 0 and less than 5.

B: An amount of coagulated product remaining on a sieve is at least 6 and less than 10.

C: An amount of coagulated product remaining on a sieve is at least 10 and less than 30.

D: An amount of coagulated product remaining on a sieve is at least 30.

The evaluated results are shown in Table 3.

TABLE 3

| | Developer No. | Toner No. | White lines | Fog | Thin line reproduction | Toner coagulation |
|---|---|---|---|---|---|---|
| Example 1 | 1 (1Bk, 1C, 1M, 1Y) | 1 (1Bk, 1C, 1M, 1Y) | B | A | A | B |
| Example 2 | 2 (2Bk, 2C, 2M, 2Y) | 2 (2Bk, 2C, 2M, 2Y) | | A | A | A |
| Example 3 | 3 (3Bk, 3C, 3M, 3Y) | 3 (3Bk, 3C, 3M, 3Y) | A | A | A | A |
| Example 4 | 4 (4Bk, 4C, 4M, 4Y) | 4 (4Bk, 4C, 4M, 4Y) | B | B | A | A |
| Example 5 | 5 (5Bk, 5C, 5M, 5Y) | 5 (5Bk, 5C, 5M, 5Y) | A | A | A | A |
| Example 6 | 6 (6Bk, 6C, 6M, 6Y) | 6 (6Bk, 6C, 6M, 6Y) | A | A | A | A |
| Example 7 | 7 (7Bk, 7C, 7M, 7Y) | 7 (7Bk, 7C, 7M, 7Y) | B | B | A | A |
| Example 8 | 8 (8Bk, 8C, 8M, 8Y) | 8 (8Bk, 8C, 8M,8Y) | C | B | A | A |
| Example 9 | 13 (13Bk, 13C, 13M, 13Y) | 13 (13Bk, 13C, 13M, 13Y) | B | C | B | A |
| Example 10 | 14 (14Bk, 14C, 14M, 14Y) | 14 (14Bk, 14C, 14M, 14Y) | A | A | B | A |
| Example 11 | 9 (9Bk, 9C, 9M, 9Y) | 9 (9Bk, 9C, 9M, 9Y) | C | C | B | C |
| Example 12 | 10 (10Bk, 10C, 10M, 10Y) | 10 (10Bk, 10C, 10M, 10Y) | C | C | B | C |
| Example 13 | 11 (11Bk, 11C, 11M, 11Y) | 11 (11Bk, 11C, 11M, 11Y) | C | C | B | B |
| Example 14 | 12 (12Bk, 12C, 12M, 12Y) | 12 (12Bk, 12C, 12M, 12Y) | C | C | B | B |
| Example 15 | 15 (15Bk, 15C, 15M, 15Y) | 15 (15Bk, 15C, 15M, 15Y) | C | C | B | B |
| Comparative example 1 | 16 (16Bk, 16C, 16M, 16Y) | 16 (16Bk, 16C, 16M, 16Y) | D | D | D | D |
| Comparative example 2 | 17 (17Bk, 17C, 17M, 17Y) | 17 (17Bk, 17C, 17M, 17Y) | D | D | D | A |
| Comparative example 3 | 18 (18Bk, 18C, 18M, 18Y) | 18 (18Bk, 18C, 18M, 18Y) | D | D | D | D |
| Comparative example 4 | 19 (19Bk, 19C, 19M, 19Y) | 19 (19Bk, 19C, 19M, 19Y) | D | D | D | D |

It is to be understood that an excellent result of any of the above evaluation items has been obtained in Examples 1-13 employing toners of the present invention, resulting in the stable storage performance as shown in Table 3, whereas in the case of Comparative examples 1 and 2 employing toners outside the scope of the present invention, no reliable results relating to the above evaluation items have been obtained, resulting in the unstable storage performance. In the case of Comparative examples 3 and 4, no shell thickness could be measured since a clear boundary between a shell and a core was not observed.

EFFECT OF THE INVENTION

Since a polymerizable monomer is polymerized in the dispersion of associated particles formed by association-fusing resin particles to coat the associated particle surface by the resin formed via polymerization, toner of the present invention having stable storage performance even at high temperature can be realized. As a result, even though the high-speed compact type image forming apparatus is placed for a long duration in the environment such that a temperature inside the apparatus is easy to rise, a method of manufacturing the toner capable of forming excellent toner images with no fusing to a developing device is possible to be provided.

Above all, since the stable storage performance can be added to the toner used for low temperature fixation having the extremely difficult maintenance of performance at high temperature in conventional technology, the toner used for low temperature fixation has recently been possible to be installed in high-speed compact type printers accompanied with high market demand. As a result, the toner image formation can be conducted at lower fixing temperature than before, whereby electric power consumed via image formation can be largely reduced to realize environmental conscious image formation.

What is claimed is:

1. A method of manufacturing toner comprising the steps of:

(a) adding oil-droplets containing a radically polymerizable monomer into an associated particle dispersion formed by association-fusing resin particles and colorant particles; and (b) forming a shell by coating a resin produced via polymerization on a surface of the associated particle by polymerizing the radically polymerizable monomer in the associated particle dispersion, wherein a hydrophilicity degree of the resin contained in the shell is larger than a hydrophilicity degree of a resin contained in the associated particle.

2. The method of manufacturing toner of claim 1, wherein satisfied is $(Sb-Sa) \geqq 5$, where Sb represents a hydrophilicity degree of the resin contained in the shell, and Sa represents a hydrophilicity degree of the resin contained in the associated particle.

3. The method of manufacturing toner of claim 2, wherein a median particle diameter in terms of a volume standard is 2-7 μm, average circularity is 0.920-0.975, and a thickness of the shell is 10-200 nm.

4. The method of manufacturing toner of claim 3, wherein satisfied is $40 \geqq (Sb-Sa) \geqq 5$.

5. The method of manufacturing toner of claim 1, wherein a median particle diameter in terms of a volume standard is 2-7 μm, average circularity is 0.920-0.975, and a thickness of the shell is 10-200 nm.

6. The method of manufacturing toner of claim 1, wherein the resin contained in the shell has a cross-linked structure.

7. The method of manufacturing toner of claim 2, wherein the resin contained in the shell has a cross-linked structure.

8. The method of manufacturing toner of claim 3, wherein the resin contained in the shell has a cross-linked structure.

9. The method of manufacturing toner of claim 6, wherein cross-linking agents used for the resin comprise aromatic polyvinyl compounds.

10. The method of manufacturing toner of claim 6, wherein the cross-linking agents comprise polyvinyl esters of aromatic polyvalent carboxylic acid.

11. The method of manufacturing toner of claim 6, wherein the cross-linking agents comprise divinyl esters of nitrogen-containing aromatic compound.

12. The method of manufacturing toner of claim 6, wherein the cross-linking agents are vinyl esters of unsaturated heterocyclic compound carboxylic acid.

13. The method of manufacturing toner of claim 6, wherein the cross-linking agents comprise (meth) acrylic acid esters of linear polyhydric alcohol.

14. The method of manufacturing toner of claim 6, wherein the cross-linking agents comprise (meth) acrylic acid esters of branching substitution polyhydric alcohol.

15. The method of manufacturing toner of claim 6, wherein the cross-linking agents comprise polyvinyl esters of polyhydric carboxylic acid.

16. The method of manufacturing toner of claim 6, wherein the cross-linking agents comprise used singly or in combination with at least two kinds.

* * * * *